US012342968B1

(12) United States Patent
Kalinowski et al.

(10) Patent No.: US 12,342,968 B1
(45) Date of Patent: Jul. 1, 2025

(54) WHOLE BODY ICE BATH

(71) Applicant: Ice Spas LLC, Casper, WY (US)

(72) Inventors: Joshua Kalinowski, Casper, WY (US); John Heisey, Casper, WY (US); Luke Humphreys, Sidney, NE (US); William Branum, Kailua, HI (US); Evan Christian Solida, Grand Junction, CO (US)

( * ) Notice: Subject to any disclaimer, the term of this patent is extended or adjusted under 35 U.S.C. 154(b) by 110 days.

(21) Appl. No.: 18/539,003

(22) Filed: Dec. 13, 2023

(51) Int. Cl.
*A47K 3/022* (2006.01)

(52) U.S. Cl.
CPC ..... *A47K 3/022* (2013.01)

(58) Field of Classification Search
CPC ..... A47K 3/022; A47K 3/02
USPC ..... 4/592
See application file for complete search history.

(56) References Cited

U.S. PATENT DOCUMENTS

| | | | | | |
|---|---|---|---|---|---|
| 4,118,810 | A * | 10/1978 | Brickhouse | A47K 3/006 | 4/590 |
| D261,796 | S * | 11/1981 | Queen | 4/604 | |
| 5,459,887 | A * | 10/1995 | Roman | A61H 33/6073 | 4/574.1 |
| 5,978,983 | A * | 11/1999 | Queen | A61H 9/00 | 4/677 |
| 2004/0078887 | A1* | 4/2004 | Kuntz | A47K 3/022 | 4/556 |
| 2007/0107120 | A1* | 5/2007 | Ingraham | A47K 3/286 | 4/612 |
| 2023/0030355 | A1 | 2/2023 | Edgar | | |

FOREIGN PATENT DOCUMENTS

| | | | |
|---|---|---|---|
| CN | 202051986 | U | 11/2011 |
| CN | 219501517 | U | 8/2023 |
| GB | 2602584 | B | 1/2023 |
| JP | 2007151691 | A | 6/2007 |
| KR | 100792168 | B1 | 1/2008 |
| WO | WO 2022/039662 | A1 | 2/2022 |
| WO | WO 2022/186530 | A1 | 9/2022 |

OTHER PUBLICATIONS

Ice Barrel Bathtub Source: https://www.amazon.com/Ice-Barrel-Bathtub-Freestanding-Training/dp/BOBQCXWJND Date Accessed: Aug. 29, 2023.

* cited by examiner

*Primary Examiner* — Huyen D Le
(74) *Attorney, Agent, or Firm* — Antoinette M. Tease

(57) ABSTRACT

A whole body ice bath in the form of a tub and a pivotally attached cover having an integral step on an underside of the cover. A pair of wheels are disposed along a bottom rear end of the tub. A seat is situated inside of the tub along the rear wall of the tub. An inlet and an outlet are configured to be connected to a water chiller. The front wall, the rear wall, the first side wall, the second side wall, and the floor of the tub are comprised of a layer of insulation in between two layers of molded plastic. The first side wall, second side wall, and front wall all have portions that are offset relative to non-offset portions of the same wall.

16 Claims, 10 Drawing Sheets

WHOLE BODY ICE BATH

BACKGROUND OF THE INVENTION

1. Field of the Invention

The present invention relates generally to the field of immersion baths, and more particularly, to a portable ice bath that is configured to contain one or more persons.

2. Description of the Related Art

The present invention is intended to provide a portable and functional way for persons to immerse themselves in an ice bath. The present invention was designed with the following goals in mind: ease of use; ice retention; durability; safety, and transportation. It also incorporates features for the containment of accessories such as towels and beverages.

There is little prior art in the field of immersion baths for human beings, but one example of the prior art is U.S. Patent Application Pub. No. 2023/0030355 (Edgar). This application discloses a cryotherapy device for manipulating the core body temperature of a human subject by utilizing both convection and conduction. The device comprises an open-topped liquid carrier vessel with an inlet and an outlet, a removable splash guard, chiller means for maintaining the liquid at a predetermined temperature, and a jet inlet for discharging liquid or a combination of liquid and air into the liquid carrier vessel. A pump is configured to create a jet stream within the liquid carrier vessel. The splash guard includes an aperture that allows the jet stream to contact the exposed skin of a person whose body part is placed on top of the splash guard. Unlike the present invention, this particular invention is not a full-immersion bath. Similar prior art references incorporate refrigeration and/or heating modules (which are not part of the present invention) or are configured to receive only part of the body.

It is an object of the present invention to provide a full-immersion ice bath with a pivotable cover and a step that is integrated into the cover to facilitate ingress and egress into and out of the ice bath. It is a further object of the present invention to provide towel and cup holders that are accessible by a person who is positioned within the ice bath. It is yet another object of the present invention to provide wheels that allow the ice bath to be moved from one location to another.

BRIEF SUMMARY OF THE INVENTION

The present invention is a whole body ice bath comprising: a tub that comprises a front wall, a rear wall, a first side wall, a second side wall, and a floor; a cover that is pivotally connected to a top rear edge of the tub and that comprises an integral step on an underside of the cover; a pair of wheels that are disposed along a bottom rear end of the tub, each wheel being configured to rotate about a shaft; and a seat that is situated inside of the tub along the rear wall of the tub; and an inlet and an outlet, each of which is configured to be connected to a water chiller; wherein the front wall, the rear wall, the first side wall, the second side wall, and the floor of the tub are comprised of a layer of insulation in between two layers of molded plastic; and wherein a portion of the first side wall is offset relative to a non-offset portion of the first side wall, a portion of the second side wall is offset relative to a non-offset portion of the second side wall, and a portion of the front wall is offset relative to a non-offset portion of the front wall. In a preferred embodiment, the center part of each of the first and second side walls of the tub comprises a vertical bend of less than ten degrees. The cover preferably comprises a bend on either side of the cover corresponding to the vertical bend in the first and second side walls of the tub.

In a preferred embodiment, the cover further comprises a front edge that is configured to stabilize the front end of the cover against a ground surface when the cover is in an open position. Preferably, the invention further comprises a towel rod that is disposed on a top part of the front wall of the tub. The towel rod preferably comprises a first end and a second end, and a cup holder is situated on both the first end and the second end of the towel rod.

In a preferred embodiment, the invention further comprising a first latch and a second latch, each of which is situated on the front edge of the cover and configured to secure the cover to the front wall of the tub. Preferably, the front edge of the cover comprises a first end and a second end; wherein each of the first end and the second end of the front edge of the cover comprises a padlock receiving area; wherein a top edge of the front wall of the tub comprises a first end and a second end; and wherein each of the first end and the second end of the top edge of the front wall of the tub comprises a padlock receiving area that is configured to mate with one of the two padlock receiving areas on the front edge of the cover to receive a padlock. The invention preferably further comprises a drain port that is situated in a bottom part of the front wall of the tub and configured to allow water to be drained from inside of the tub. A two-way valve is preferably situated directly above the drain port.

In a preferred embodiment, the cover comprises a raised area that rises from a front edge of the raised area to a top edge at a first angle and tapers downward to a rear edge of the cover at a second angle, the first angle being greater than the second angle; wherein the raised area comprises a first surface that extends from the front edge of the raised area to the top edge and a second surface that extends from the top edge to a hinge at the rear edge of the cover; and wherein the second surface of the raised area comprises foam decking. Preferably, the layer of insulation in the front wall, the rear wall, the first side wall, the second side wall, and the floor has a thickness; and wherein the thickness of the layer of insulation in the floor is greater than the thickness of the layers of insulation in the front wall, the rear wall, the first side wall, and the second side wall. The cover is preferably comprised of a layer of insulation in between two layers of molded plastic; and wherein the raised area of the cover is filled with insulation.

In a preferred embodiment, a bottom center of the rear wall of the tub comprises a depression that is situated behind the seat on the inside of the tub. Preferably, the invention further comprises a plurality of non-slip pads on an underside of the floor of the tub. A rubber gasket that is preferably positioned around a perimeter of the underside of the cover and configured to couple with a lip around a perimeter of a top edge of the tub to form a seal when the cover is in a closed position.

REFERENCE NUMBERS

Figure 1:
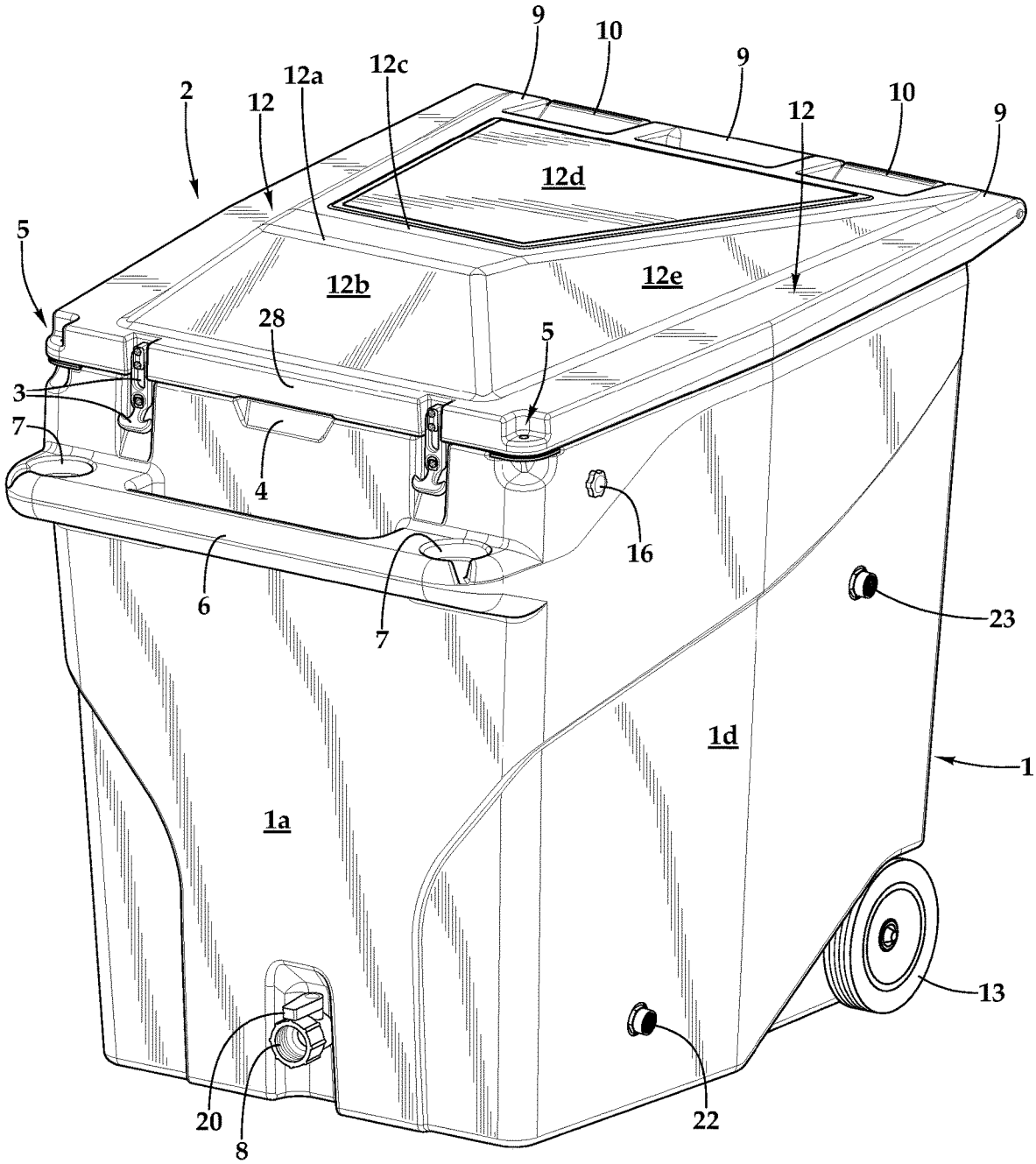
FIG. 1 is a front perspective view of the present invention shown with the cover in a closed position.

1 Tub
1*a* Front wall (of tub)
1*b* Rear wall (of tub)
1*c* Depression (in rear wall of tub)
1*d* First side wall (of tub)
1*e* Second side wall (of tub)
1*f* Floor (of tub)
2 Cover
2*a* Bend (in cover)
3 Latch
4 Recess/hand grip
5 Padlock receiving area
5*a* Floor (of padlock receiving area)
5*b* Hole (in floor of padlock receiving area)
5*c* Wall (of padlock receiving area)
6 Towel bar
7 Cup holder
7*a* Break or slot (in cup holder)
8 Drain port
9 Hinge
10 Protrusion
11 First shaft
12 Raised area
12*a* Top edge (of raised area)
12*b* First surface (of raised area)
12*c* Second surface (of raised area)
12*d* Foam decking
12*e* Side surface (of raised area)
13 Wheel
14 Second shaft
15 Foam insulation
16 Foam insulation injection port
17 Non-slip pad
18 Center seam (in tub)
19 Base (of seat in tub)
20 Two-way valve
21 Bracket
22 Outlet
23 Inlet
24 Lip (on top of tub)
25 Seat
26 Rubber gasket
27 Step
27*a* Base (of step)
27*b* Side wall (of step)
27*c* Outer support bracket (of step)
28*d* Central support bracket (of step)
28 Foot (front-most end of cover)

DETAILED DESCRIPTION OF INVENTION

FIG. 1 is a front perspective view of the present invention shown with the cover in a closed position. As shown in this figure, the present invention comprises a tub 1 with a cover 2. The tub 1 is comprised of a front wall 1*a*, a rear wall 1*b*, a first side wall 1*d* and a second side wall 1*e*. The cover 2 is pivotally attached to the top rear of the tub 1 (see FIG. 2). Two latches 3 are situated along the front edge of the cover and are configured to secure the front end of the cover 2 to the top of the front wall 1*a* of the tub 1. In a preferred embodiment, the latch 3 is a ROTO™ molded T-handle rubber cooler latch. At the center of the top edge of the front wall 1*a* of the tub 1 is a recess 4 that is configured to facilitate lifting of the cover 2 by hand when the latches 3 are unlocked. The cover 2 has two front corners, each of which is configured to form a padlock receiving area 5. The padlock receiving area 5 is comprised of a floor 5*a* with an aperture 5*b* through which the hook of a padlock may be inserted and a contiguous wall 5*c* that defines the padlock receiving area 5 (see also FIG. 3). Note that the padlock receiving areas 5 on the cover are configured to mate with similar padlock receiving areas on either side of the top front edge of the front wall 1*a* of the tub 1.

A towel bar 6 is provided across the entire width of the front wall 1*a* of the tub 1, directly underneath the latches 3. The towel bar 6 preferably comprises a cup holder 7 configured to receive a beverage holder on each end of the towel bar 6. A drain port 8 is situated at the bottom of the front wall 1*a* of the tub 1. The drain port 8 may be coupled to a garden hose (not shown). The purpose of the drain port 8 is to allow water to be drained from the tub 1 after use.

Figure 2:
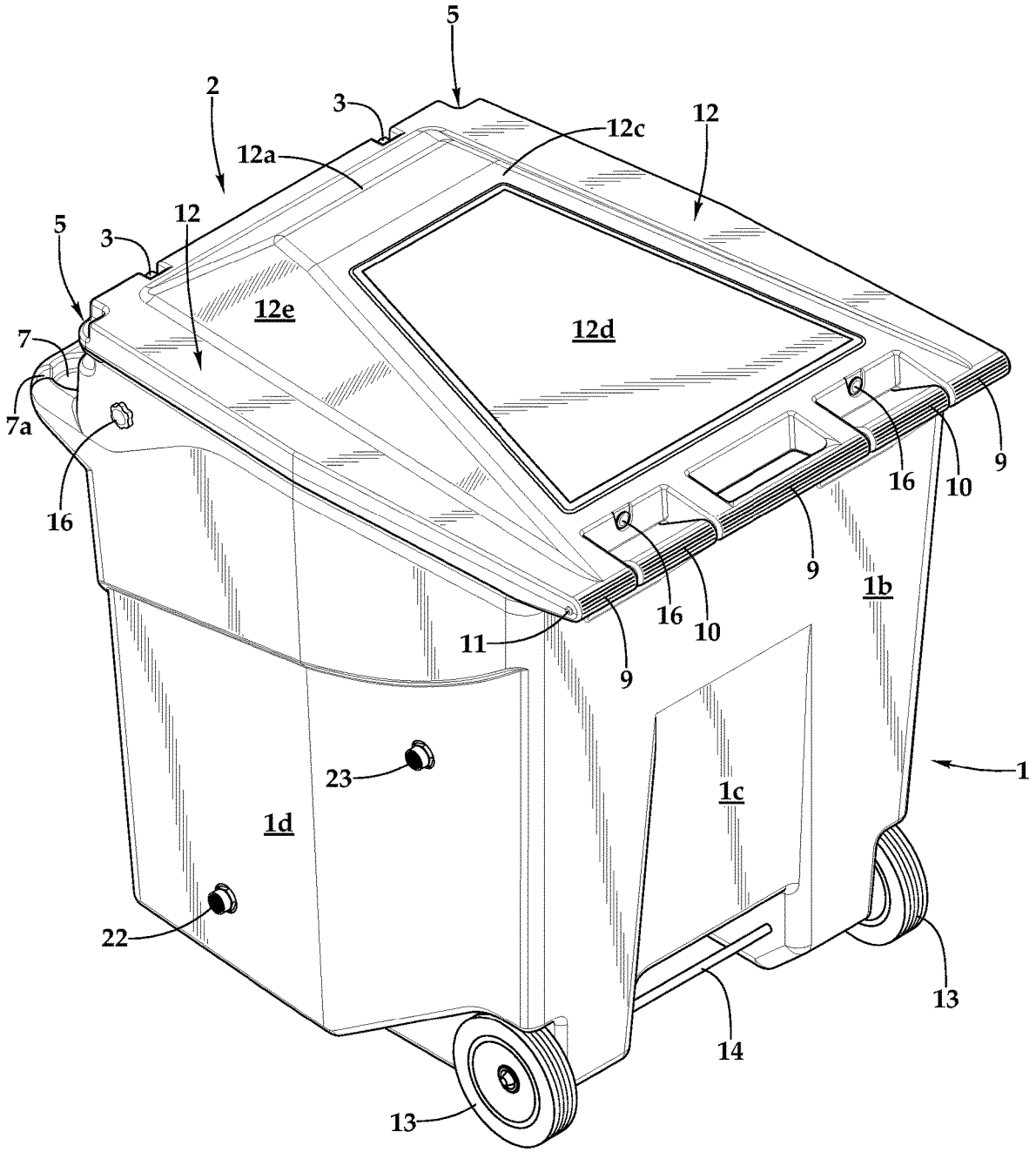
FIG. 2 is a rear perspective view of the present invention shown with the cover in a closed position.
Figure 9:
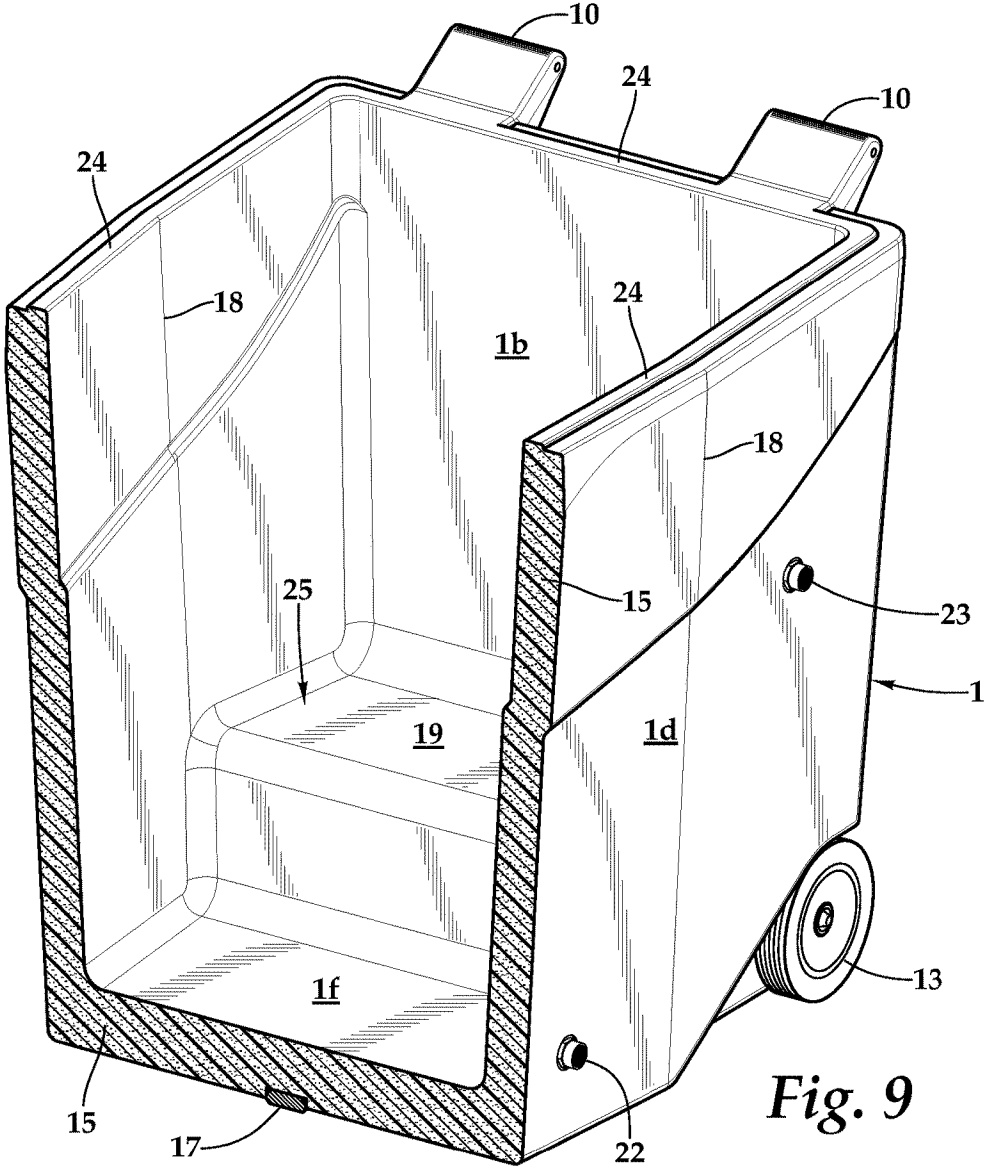
FIG. 9 is a second section view of the present invention taken at the line shown in FIG. 12.

FIG. 2 is a rear perspective view of the present invention shown with the cover in a closed position. This figure shows the hinge 9 by which the cover 2 is pivotally connected to the rear of the tub 1. As shown in FIG. 9, two protrusions 10 extend diagonally upward from the top edge of the rear wall 1*b* and are configured to receive a first shaft 11 about which the cover 2 rotates. The cover 2 comprises a raised area 12 that rises steeply from the front part of the cover to a top edge 12*a* and then tapers gradually downward to the rear edge of the cover 2 at the hinge 9. The raised area 12 comprises a first surface 12*b*, which extends from the front edge of the raised area 12 proximate to the front edge of the cover 2 to the top edge 12*a*, and a second surface 12*c*, which extends from the top edge 12*a* to the hinge 9 at the rear edge of the cover 2. In a preferred embodiment, the second surface 12*c* comprises foam decking 12*d* for graphic placement.

Referring to FIG. 2, a pair of wheels 13 is disposed at the bottom rear of the tub 1. The wheels 13 are configured to rotate about a second shaft 14. The tub 1 and cover 2 are comprised of a molded plastic body with foam insulation 15 (see FIG. 12) injected in between two layers of plastic. FIG. 2 shows the foam insulation injection ports 16 on the cover 2. A similar foam injection port 16 is situated on a first side wall 1*d* of the tub 1 (see FIGS. 1 and 2). Note that the rear wall 1*b* of the tub 1 comprises a depression 1*c*. When the tub is filled with water, each of the tub walls (front, side and rear) must have a break in it to prevent the wall from bowing out due to the pressure of the water inside of the tub. Accordingly, none of the walls of the tub is a flat surface; each wall has at least two different surface levels. The depression 1*c* shown in FIG. 2 is in the form of a rectangle that is situated in the bottom center of the rear wall 1*b* behind the seat 25. In a preferred embodiment, the molded plastic tub body is made of DOW™ MDPE DPDA-3152 NT 7 Medium Density Polyethylene Resin manufactured by The Dow Chemical Company of Midland, Michigan.

Figure 3:
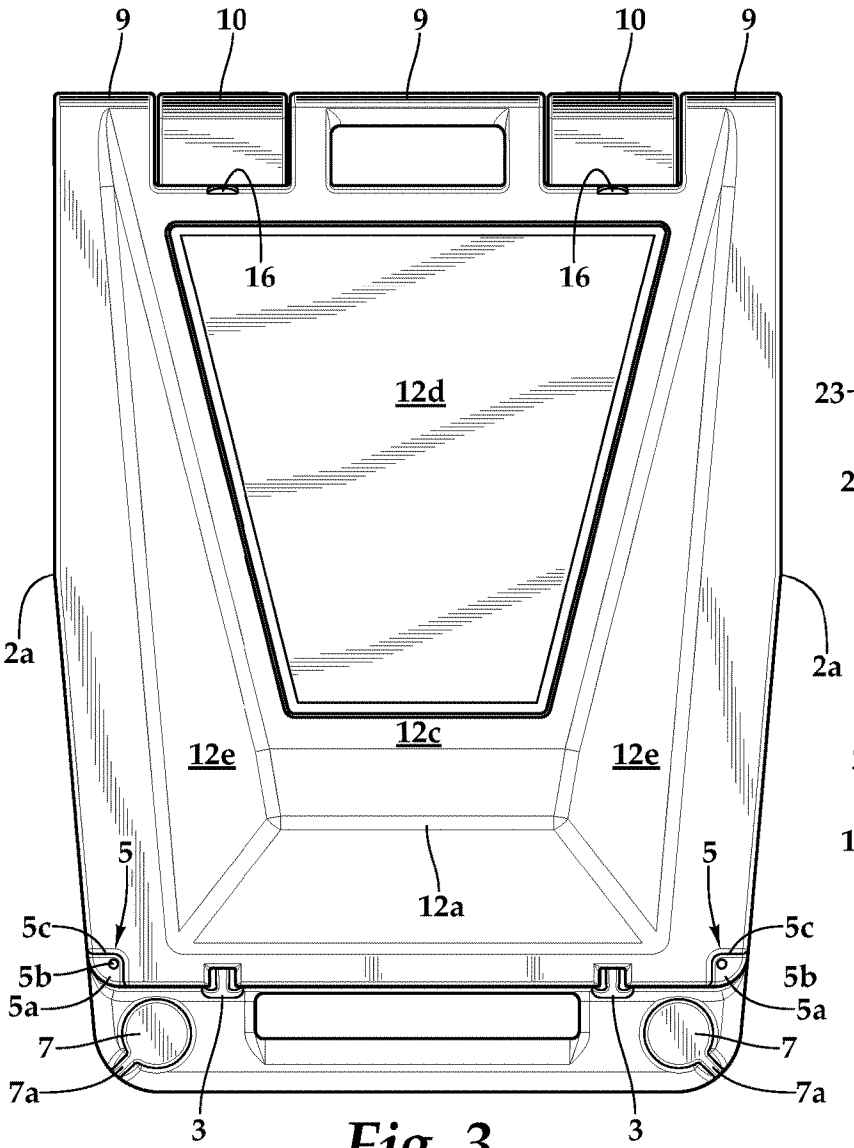
FIG. 3 is a top view of the present invention shown with the cover in a closed position.

FIG. 3 is a top view of the present invention shown with the cover in a closed position. As shown in this figure, the raised area 12 further comprises two opposing side surfaces 12*e* that are angled inward from bottom to top. The entire raised area 12 is comprised of the first surface 12*a*, the second surface 12*b*, and the two side surfaces 12*e*. Viewed from the top, the raised area 12 is in the form of an isosceles trapezium. The cover 2 preferably comprises a bend 2*a* on the right and left sides of the cover. The sides of the cover 2 extend from the rear edge of the cover at a ninety-degree angle and then taper slightly inward (preferably at a five-degree angle) after the bend 2*a*. In this manner, the front of the cover 2 is narrower than the rear end of the cover 2. This bend 2*a* in the cover 2 and in the body of the tub 1 allows the tub 1 to "flex" at the center seam 18 when the tub is full of water (see also FIGS. 4 and 9).

Figure 4:
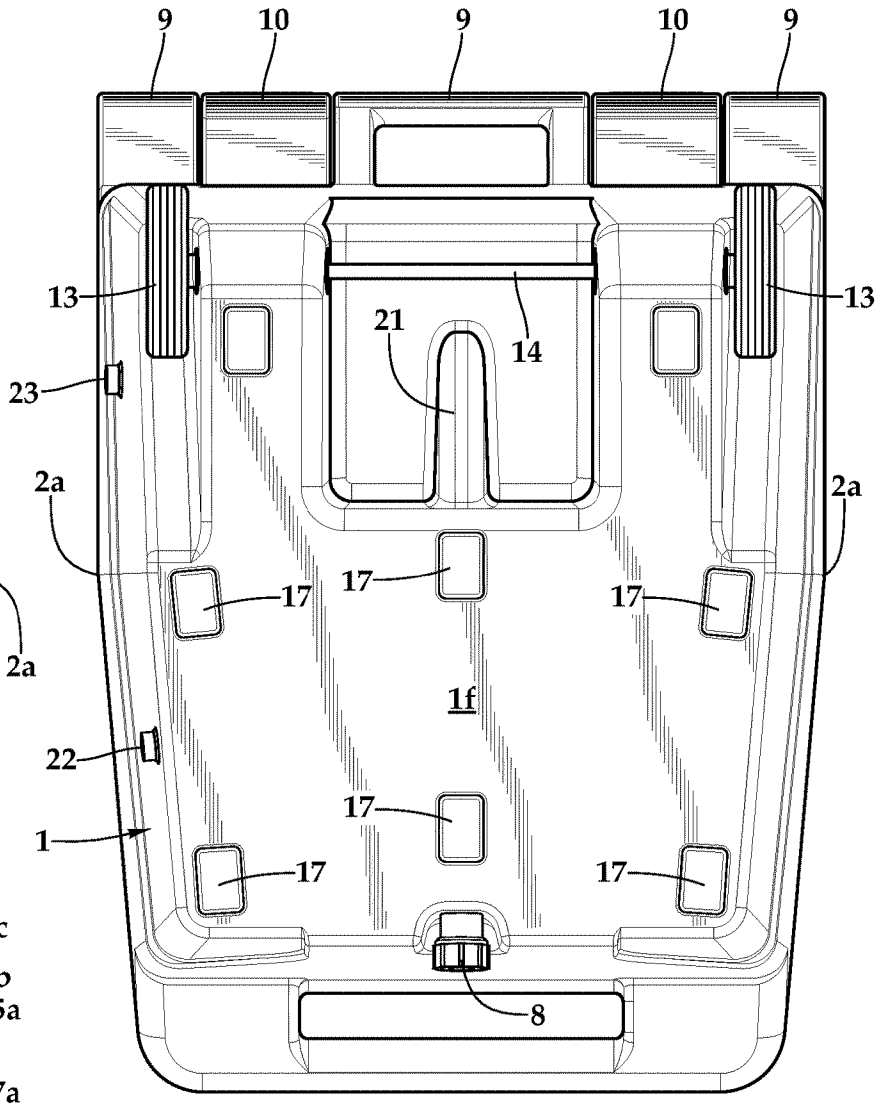
FIG. 4 is a top view of the present invention.

FIG. 4 is a bottom view of the present invention. As shown in this figure, the tub 1 comprises a floor 1*f* on the underside of which are disposed a plurality of rubber, non-slip pads 17 that help secure the tub to the ground when in use. This figure also shows the base 19 of the seat 25 inside of the tub 1 (see FIG. 9). In a preferred embodiment, each cup holder 7 comprises a break or slot that is configured to allow water to drain out of the cup holder.

Figure 6:
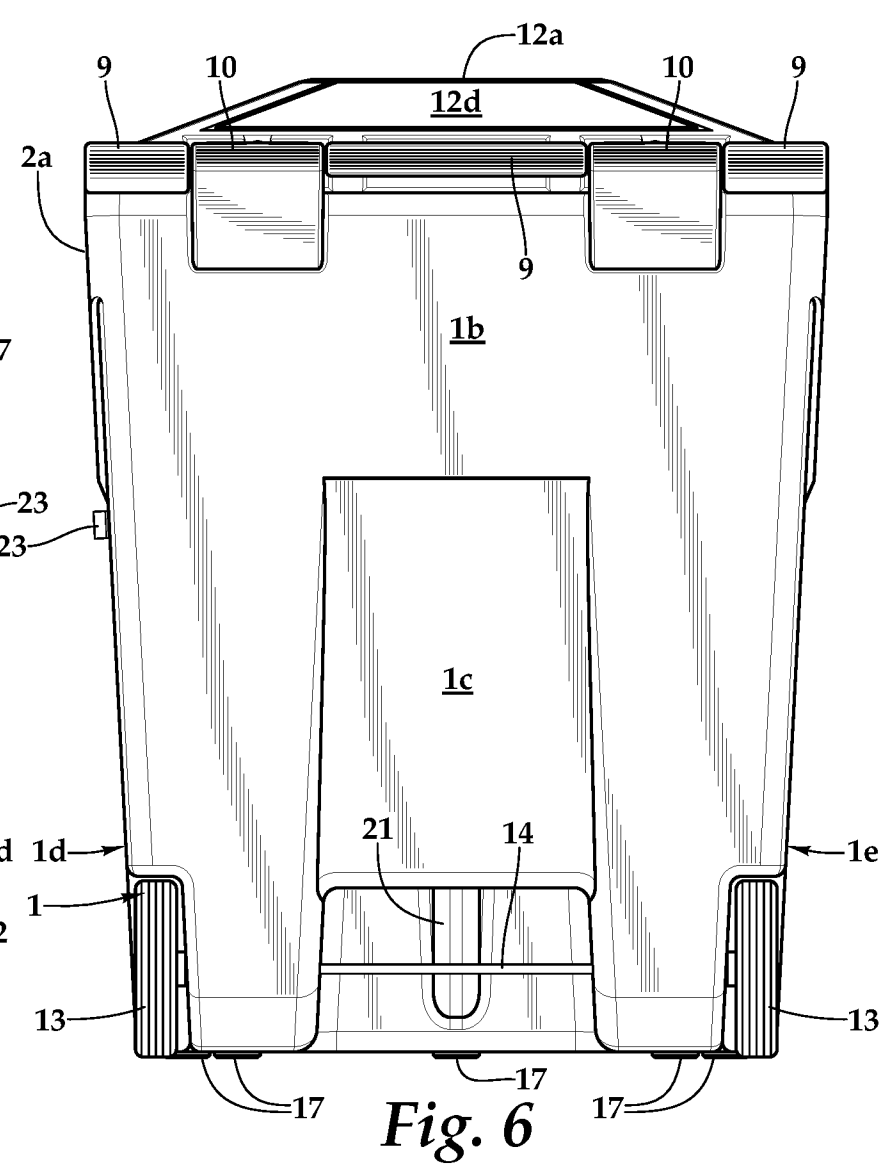
FIG. 6 is a rear view of the present invention shown with the cover in a closed position.
Figure 5:
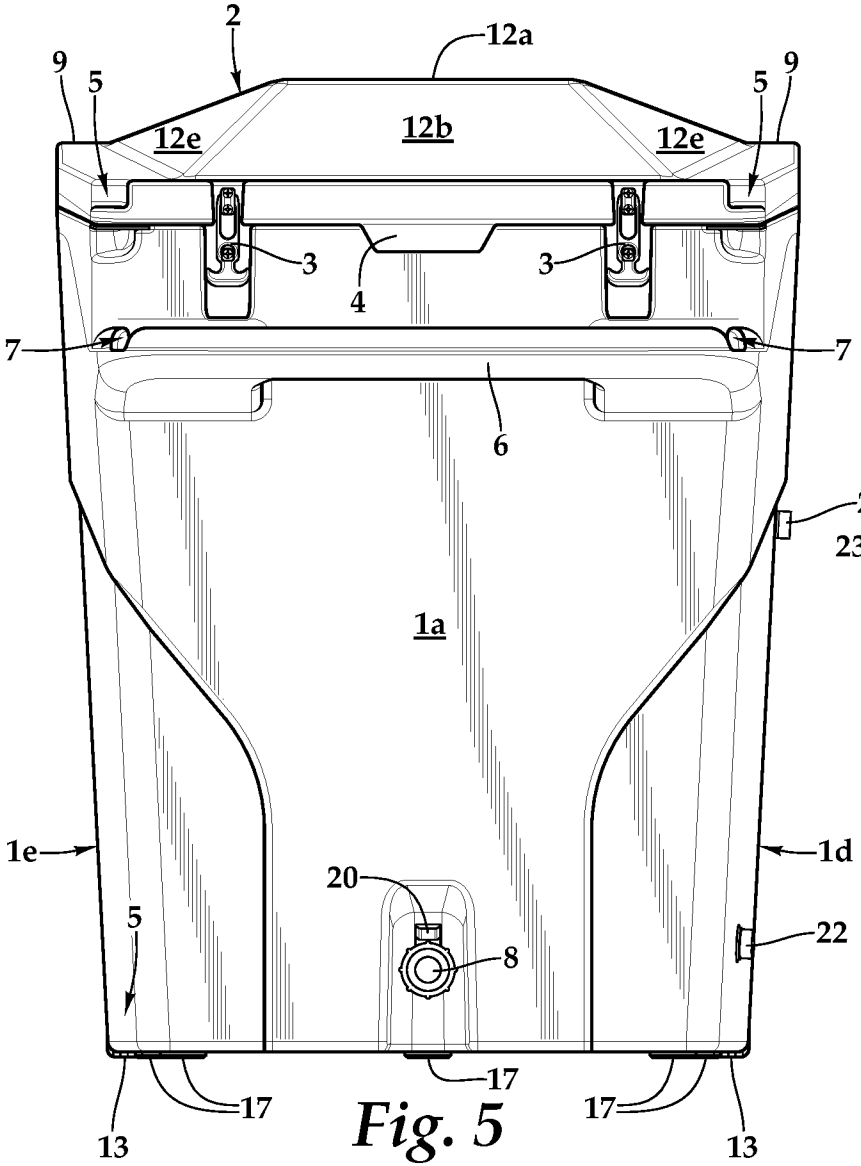
FIG. 5 is a front view of the present invention shown with the cover in a closed position.

FIG. 5 is a front view of the present invention shown with the cover in a closed position, and FIG. 6 is a rear view of the present invention shown with the cover in a closed position. A two-way valve 20 is preferably situated directly above the drain port 18. A bracket 21 is located directly underneath and configured to support the base 19 of the seat 25. The first side wall 1*d* of the tub 1 comprises an outlet 22 and an inlet 23 for a water chiller (not shown). Water inside of the tub is drawn through the outlet 22 into the water chiller and then pumped back into the tub 1 via the inlet 23, thereby maintaining a constant temperature of the water inside of the tub 1 and circulating and filtering the water. In a preferred embodiment, the water chiller is the Spartan™ water chiller manufactured by Spartan Ice Bath of Old Town, Maine.

Figure 7:
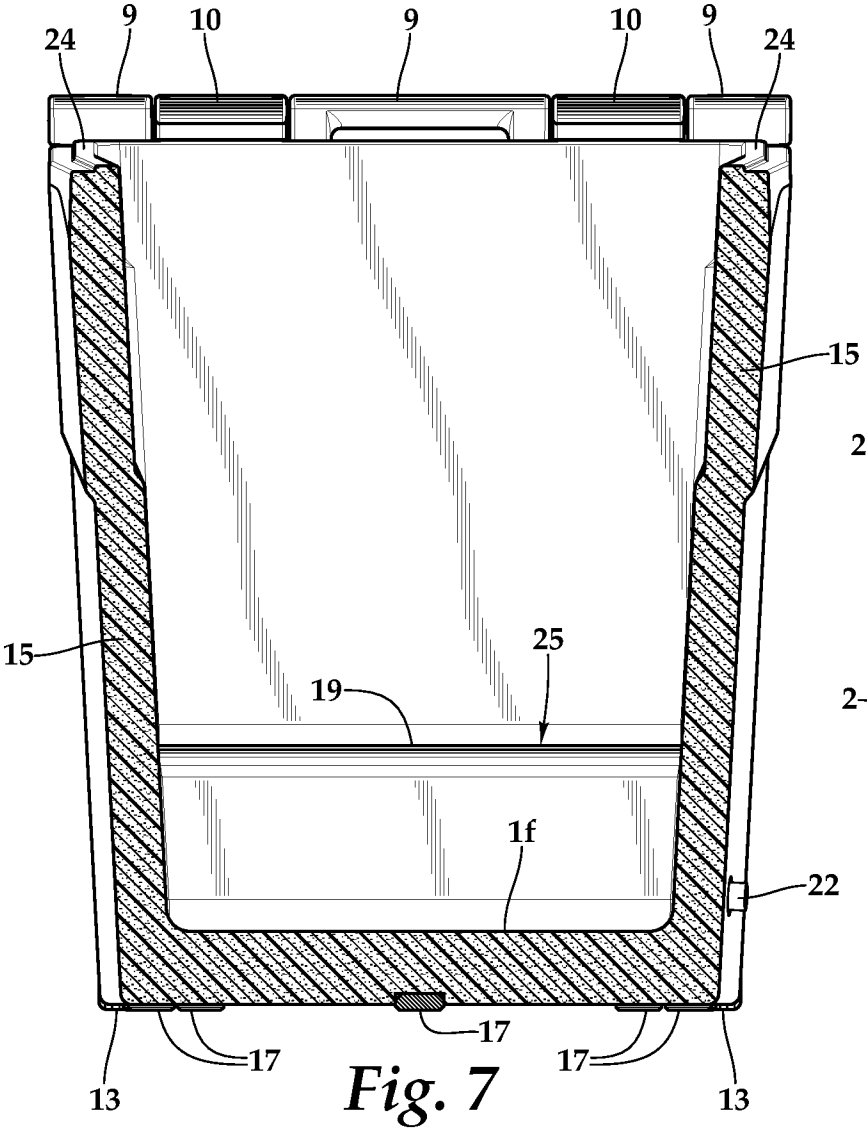
FIG. 7 is a first section view of the present invention taken at the line shown in FIG. 12.
Figure 12:
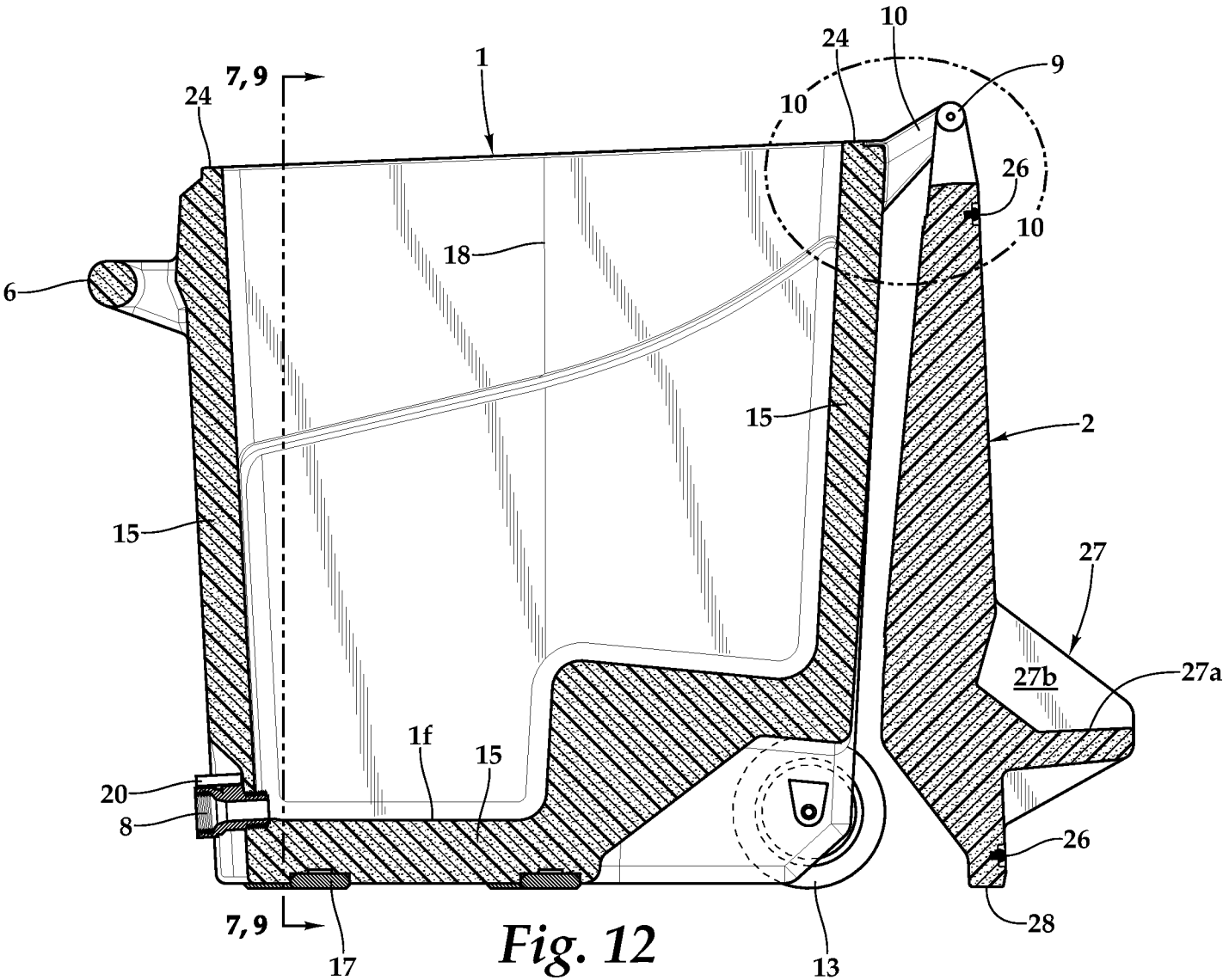
FIG. 12 is a side section view of the present invention show with the cover in an open position.

FIG. 7 is a first section view of the present invention taken at the line shown in FIG. 12. This figure shows the foam insulation 15 within the walls of the tub 1. In a preferred embodiment, the foam insulation is ECOFOAM™ HD manufactured by Foam Supplies, Inc. of Earth City, Missouri. Note also that the thickness of the foam is preferably greater on the floor 1*f* of the tub than it is on the side walls 1*d*, 1*e*. As shown in this figure, the top part of each side wall 1*d*, 1*e* is preferably offset, for the reasons explained above in connection with FIG. 2. In other words, the inside diameter (side-to-side) of the tub 1 in the top part of the tub is greater than the inside diameter of the tub in the bottom part of the tub. Similarly, the outside diameter of the tub 1 in the top part of the tub is greater than the outside diameter of the tub in the bottom part of the tub. Referring to FIGS. 1 and 5, the offset portion of the tub starts at the top back of each side wall and curves downward as it extends forwardly across the surface of the side wall; at the front wall, the offset portion curves downward and inward to the floor. In a preferred embodiment, the thickness of the front, rear and side walls of the tub is constant (that is, it does not change between the offset and non-offset portions), and it is also equal among the four walls (see also FIG. 9).

Figure 8:
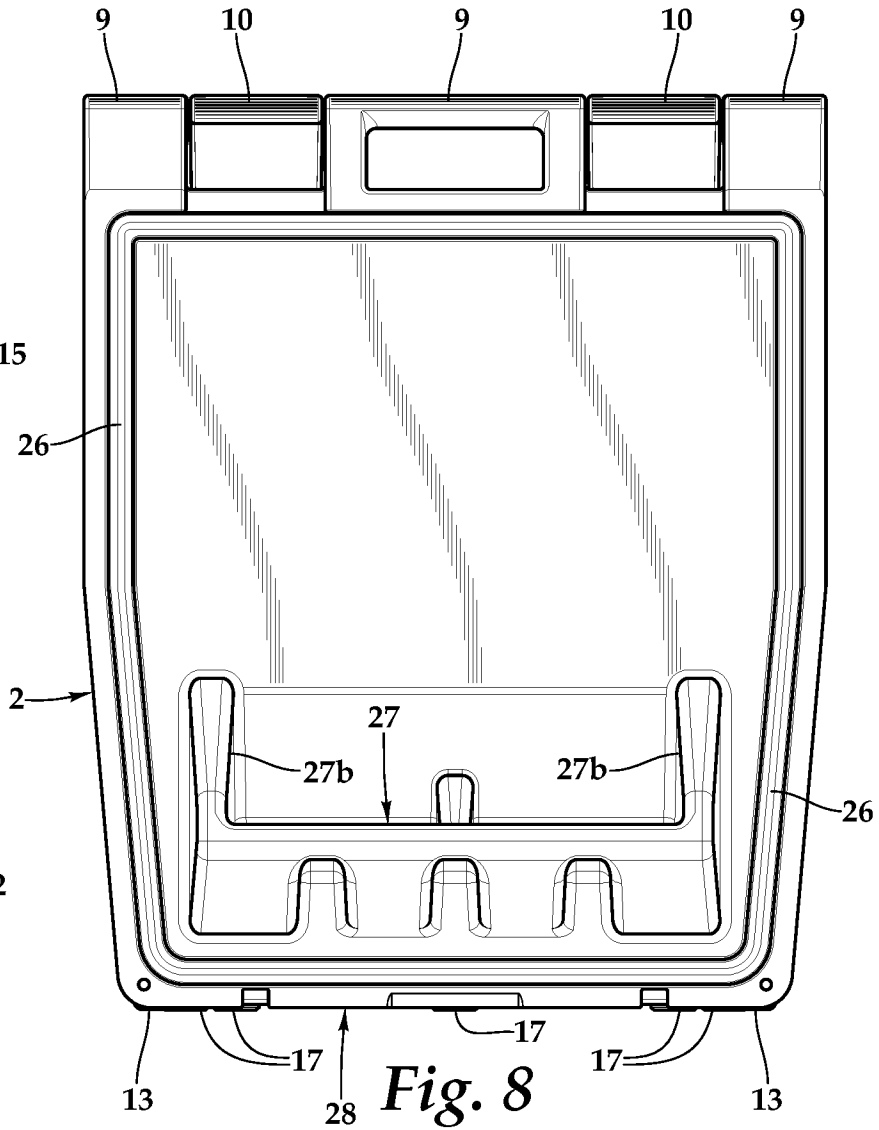
FIG. 8 is a rear view of the present invention shown with the cover in an open position.

FIG. 8 is a rear view of the present invention shown with the cover in an open position. This figure shows the integrated step 27 on the underside of the cover; note that the "underside" of the cover is the outside of the cover when the cover is in the position shown in this figure. This figure also shows the rubber gasket 26 that is positioned around the perimeter of the underside of the cover 2. This gasket 26 serves to seal the cover 2 when it is in a closed position, as explained more fully below.

FIG. 9 is a second section view of the present invention taken at the line shown in FIG. 12. As shown in this figure, the present invention comprises a seat 25 that is formed inside of the tub 1 and is set against the rear wall 1*b* of the tub. The base 19 of the seat 25 is also visible in FIG. 4.

Figure 10:
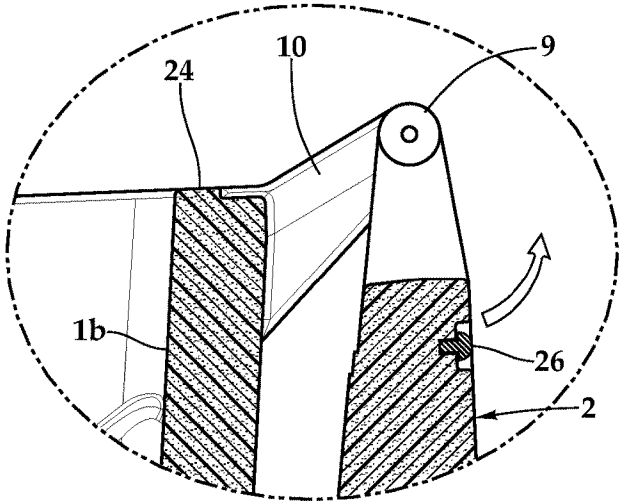
FIG. 10 is a detail section view of the present invention shown with the cover in an open position.
Figure 11:
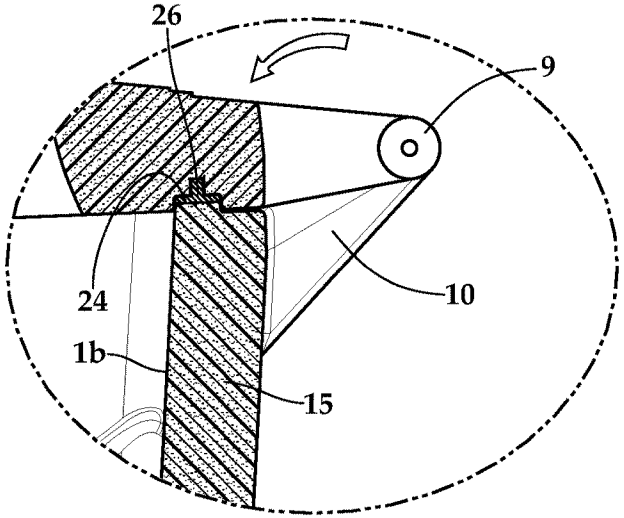
FIG. 11 is a detail section view of the present invention shown with the cover in a closed position.

FIG. 10 is a detail section view of the present invention shown with the cover in an open position, and FIG. 11 is a detail section view of the present invention shown with the cover in a closed position. As shown in these two figures, the cover 2 comprises a rubber gasket 26 that is situated around the perimeter of the underside of the cover and configured to couple with the lip 24 on the top of the tub 1 in the manner shown here (see also FIG. 13).

FIG. 12 is a side section view of the present invention show with the cover in an open position. As shown in this figure, the cover 2 comprises a step 27 that is molded into the underside of the cover 2 to enable a person to step up and into the tub 1. The step 27 is integral to the cover and molded with the cover as a single part. Note that the front-most end of the cover 2 acts as a foot 28 to stabilize the cover 2 against the ground when the cover is in an open position.

Figure 13:
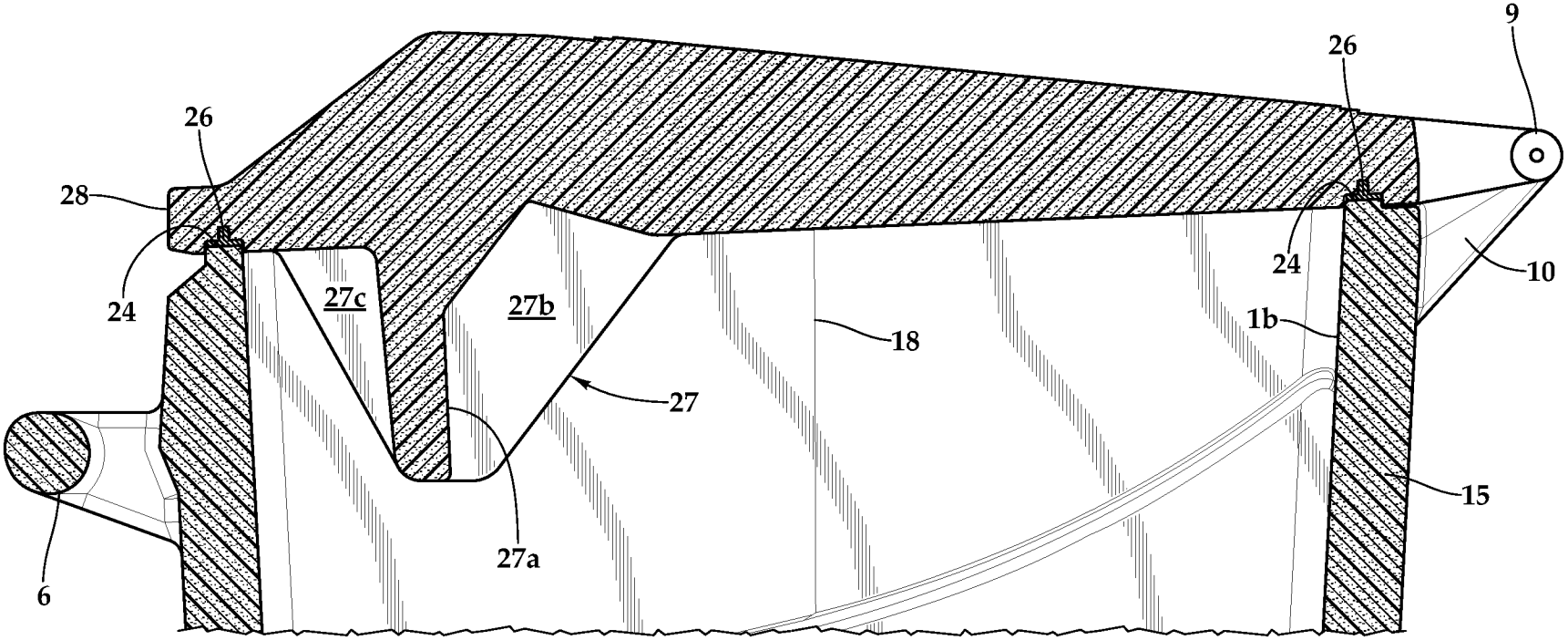
FIG. 13 is a detail section view of the cover of the present invention shown with the cover in a closed position.

FIG. 13 is a detail section view of the cover of the present invention shown with the cover in a closed position. This figure shows the integral step 27 that is described above in connection with FIG. 12. It also shows the rubber gasket 26 that engages with the lip 24 on the top of the tub 1 to form a seal.

Figure 14:
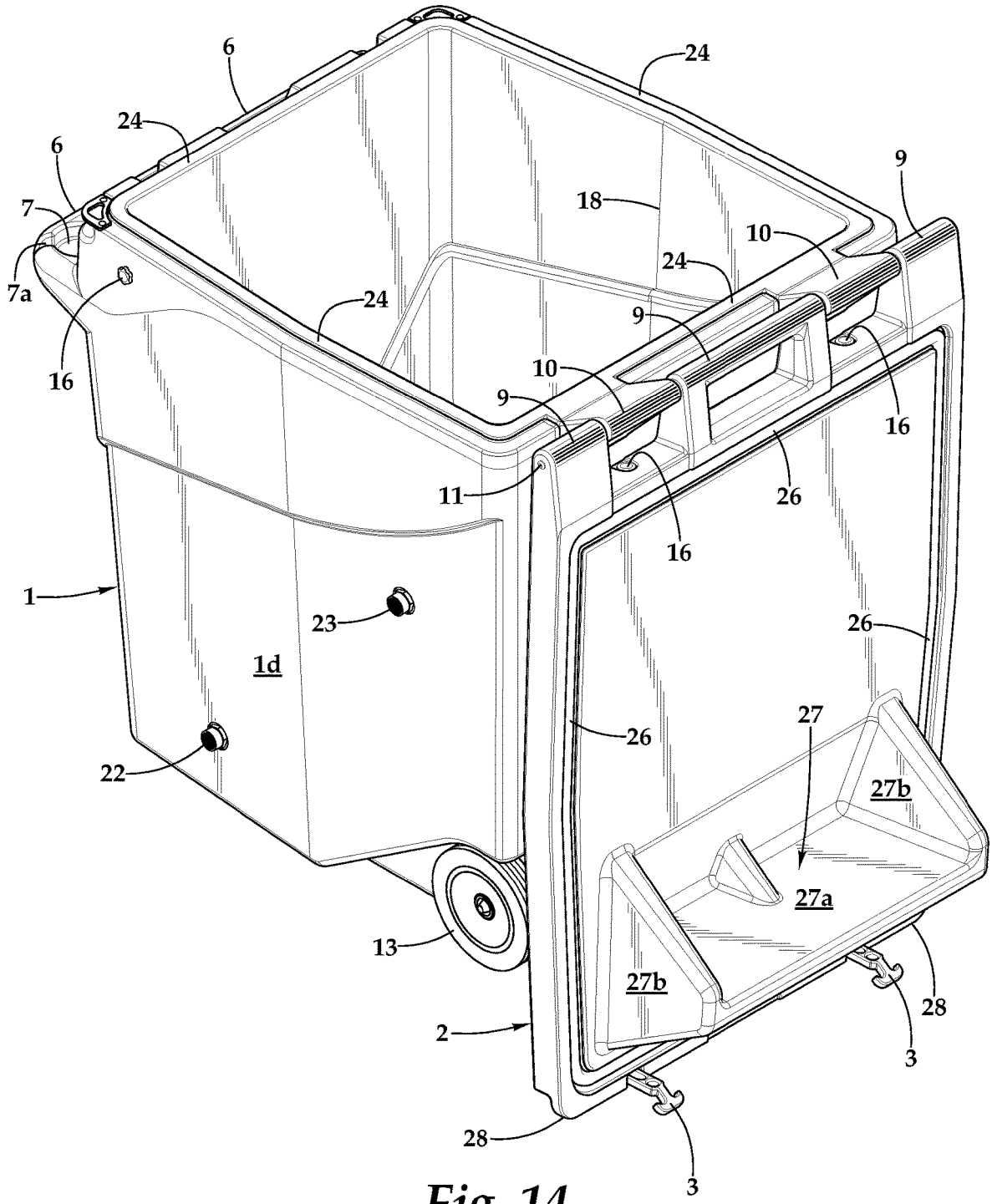
FIG. 14 is a rear perspective view of the present invention shown with the cover in an open position.
Figure 15:
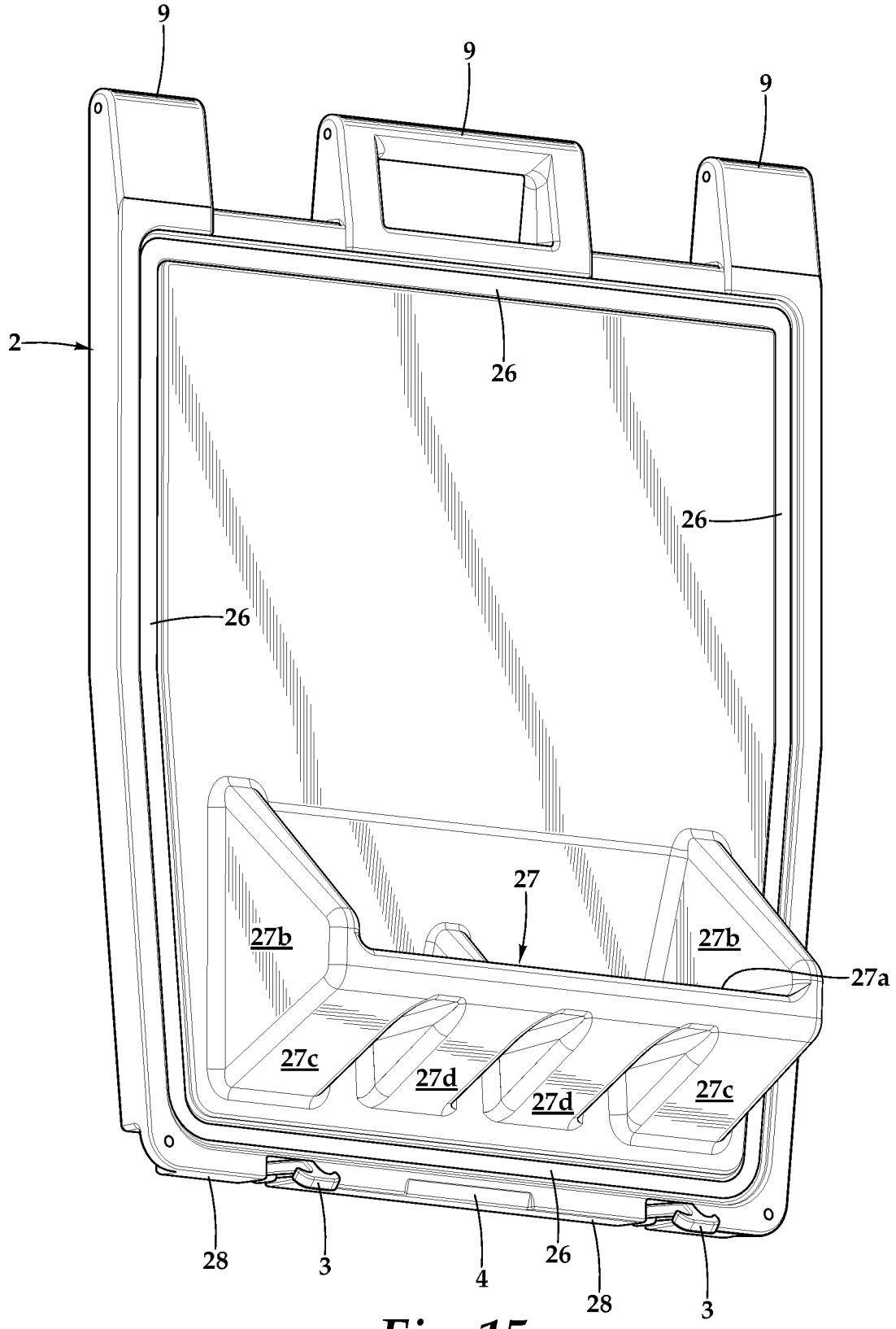
FIG. 15 is a perspective view of the underside of the cover of the present invention showing the integral step.

FIG. 14 is a rear perspective view of the present invention shown with the cover in an open position, and FIG. 15 is a perspective view of the underside of the cover of the present invention showing the integral step. As shown in these figures, the step 27 is preferably comprised of a base 27*a* and two side walls 27*b*. Each side wall 27*b* is contiguous with a support bracket 27*c* on the bottom of the step 27. Two central support brackets 27*d* are situated between the two outer support brackets 27*c* and configured to provide additional support to the base 27*a*.

The present invention presents several unique structural aspects. First, the step that is integrated into the cover allows a person to get into and out of the tub with ease. Second the drain port on the front of the tub allows a person to drain the tub in their garage without getting the floor wet. Third, the non-slip pads on the bottom of the tub help secure it (for example, to a garage floor) while in use. Fourth, the seat on the interior of the tub enables a person to rest comfortably while in the ice bath. Fifth, the inlet and outlet allow the tub to be connected to a water chiller, although the present invention may also be used without a water chiller, if desired. Furthermore, the tub is insulated, thereby providing a colder and more consistent temperature than non-insulated ice baths. The latchable and lockable cover keeps unwanted animals and debris out of the ice bath. From a safety perspective, the cover can be secured with a padlock, and the integrated step works only when the cover is open. The wheel system makes the entire system moveable and transportable.

To use the ice bath, it is placed in position, the water chiller system (if used) is attached, the drain port is closed, the cover is opened, and the tub is filled with water and ice. Once the optimum temperature is achieved, a person will use the integrated step to enter the ice bath for the desired period of time. When finished, the person will use the step to exit the ice bath. The lid is closed and locked, a garden hose is attached to the drain port, and the water is drained from the tub.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A whole body ice bath comprising:

(a) a tub that comprises a front wall, a rear wall, a first side wall, a second side wall, and a floor;

(a) a cover that is pivotally connected to a top rear edge of the tub and that comprises an integral step on an underside of the cover;

(b) a pair of wheels that are disposed along a bottom rear end of the tub, each wheel being configured to rotate about a shaft;

(c) a seat that is situated inside of the tub along the rear wall of the tub; and (d) an inlet and an outlet, each of which is configured to be connected to a water chiller;

wherein the front wall, the rear wall, the first side wall, the second side wall, and the floor of the tub are comprised of a layer of insulation in between two layers of molded plastic; and wherein a portion of the first side wall is offset relative to a non-offset portion of the first side wall, a portion of the second side wall is offset relative to a non-offset portion of the second side wall, and a portion of the front wall is offset relative to a non-offset portion of the front wall.

2. The whole body ice bath of claim 1, comprising a vertical bend of less than ten degrees situated in a center part of each of the first and second side walls of the tub.

3. The whole body ice bath of claim 2, wherein the cover comprises a bend on either side of the cover corresponding to the vertical bend in the first and second side walls of the tub.

4. The whole body ice bath of claim 1, wherein the cover further comprises a front edge that is configured to stabilize the front end of the cover against a ground surface when the cover is in an open position.

5. The whole body ice bath of claim 4, further comprising a first latch and a second latch, each of which is situated on the front edge of the cover and configured to secure the cover to the front wall of the tub.

6. The whole body ice bath of claim 4, wherein the front edge of the cover comprises a first end and a second end;

wherein each of the first end and the second end of the front edge of the cover comprises a padlock receiving area;

wherein a top edge of the front wall of the tub comprises a first end and a second end; and wherein each of the first end and the second end of the top edge of the front wall of the tub comprises a padlock receiving area that is configured to mate with one of the two padlock receiving areas on the front edge of the cover to receive a padlock.

7. The whole body ice bath of claim 1, further comprising a towel rod that is disposed on a top part of the front wall of the tub.

8. The whole body ice bath of claim 7, wherein the towel rod comprises a first end and a second end, and a cup holder is situated on both the first end and the second end of the towel rod.

9. The whole body ice bath of claim 1, further comprising a drain port that is situated in a bottom part of the front wall of the tub and configured to allow water to be drained from inside of the tub.

10. The whole body ice bath of claim 9, further comprising a two-way valve that is situated directly above the drain port.

11. The whole body ice bath of claim 1, wherein the cover comprises a raised area that rises from a front edge of the raised area to a top edge at a first angle and tapers downward to a rear edge of the cover at a second angle, the first angle being greater than the second angle;

wherein the raised area comprises a first surface that extends from the front edge of the raised area to the top edge and a second surface that extends from the top edge to a hinge at the rear edge of the cover; and wherein the second surface of the raised area comprises foam decking.

12. The whole body ice bath of claim 11, wherein the cover is comprised of a layer of insulation in between two layers of molded plastic; and wherein the raised area of the cover is filled with insulation.

13. The whole body ice bath of claim 1, wherein the layer of insulation in the front wall, the rear wall, the first side wall, the second side wall, and the floor has a thickness; and wherein the thickness of the layer of insulation in the floor is greater than the thickness of the layers of insulation in the front wall, the rear wall, the first side wall, and the second side wall.

14. The whole body ice bath of claim 1, wherein a bottom center of the rear wall of the tub comprises a depression that is situated behind the seat on the inside of the tub.

15. The whole body ice bath of claim 1, further comprising a plurality of non-slip pads on an underside of the floor of the tub.

16. The whole body ice bath of claim 1, further comprising a rubber gasket that is positioned around a perimeter of the underside of the cover and configured to couple with a lip around a perimeter of a top edge of the tub to form a seal when the cover is in a closed position.

* * * * *